US012601549B2

(12) United States Patent
Wang et al.

(10) Patent No.: US 12,601,549 B2
(45) **Date of Patent: *Apr. 14, 2026**

(54) THREE-DIMENSIONAL HEAT TRANSFER DEVICE

(71) Applicant: PURPLE CLOUD DEVELOPMENT PTE. LTD., Singapore (SG)

(72) Inventors: Xue Mei Wang, Hui Zhou City (CN); Xiao Min Zhang, Hui Zhou City (CN)

(73) Assignee: PURPLE CLOUD DEVELOPMENT PTE. LTD., Singapore (SG)

( * ) Notice: Subject to any disclaimer, the term of this patent is extended or adjusted under 35 U.S.C. 154(b) by 251 days.

This patent is subject to a terminal disclaimer.

(21) Appl. No.: 17/902,407

(22) Filed: Sep. 2, 2022

(65) Prior Publication Data

US 2023/0213288 A1 Jul. 6, 2023

(30) Foreign Application Priority Data

Jan. 6, 2022 (CN) ..... 202210011964.0

(51) Int. Cl.
*F28D 15/04* (2006.01)
*F28D 1/053* (2006.01)
(Continued)

(52) U.S. Cl.
CPC ..... *F28D 15/046* (2013.01); *F28D 1/05316* (2013.01); *F28D 15/0233* (2013.01); *F28F 3/02* (2013.01)

(58) Field of Classification Search
CPC ..... F28D 15/046; F28D 1/05316; F28D 15/0233; F28F 3/02
See application file for complete search history.

(56) References Cited

U.S. PATENT DOCUMENTS

2018/0106552 A1 4/2018 Lin
2019/0049190 A1* 2/2019 Liu ..... F28F 1/325
(Continued)

FOREIGN PATENT DOCUMENTS

CN 214095677 U 8/2021

OTHER PUBLICATIONS

First Office Action issued in corresponding Chinese Patent Application No. 202210011964.0 dated Nov. 21, 2025, with Enlgish translation (12 pages).

*Primary Examiner* — Jianying C Atkisson
*Assistant Examiner* — Khaled Ahmed Ali Al Samiri
(74) *Attorney, Agent, or Firm* — Merchant & Gould P.C.

(57) ABSTRACT

A three-dimensional heat transfer device includes a first thermally conductive casing, a second thermally conductive casing, a first capillary structure, a second capillary structure and a heat pipe. The second thermally conductive casing has a through hole. The second thermally conductive casing is mounted on the first thermally conductive casing so as to form a liquid-tight chamber. The first capillary structure is disposed on the first thermally conductive casing. The second capillary structure is disposed on the first thermally conductive casing. Projections of the first capillary structure and the second capillary structure on the outer surface and an extension surface of the outer surface are located in an extent of the outer surface, and the second capillary structure is located closer to the second thermally conductive casing than the second capillary structure. The heat pipe is disposed through the through hole and in contact with the second capillary structure.

12 Claims, 4 Drawing Sheets

(51) Int. Cl.
*F28D 15/02* (2006.01)
*F28F 3/02* (2006.01)

(56) References Cited

U.S. PATENT DOCUMENTS

2019/0343021 A1* 11/2019 Zhang ..... H01L 21/4882
2020/0355444 A1* 11/2020 Chen ..... F28D 15/0283

* cited by examiner

THREE-DIMENSIONAL HEAT TRANSFER DEVICE

CROSS-REFERENCE TO RELATED APPLICATIONS

This non-provisional application claims priority under 35 U.S.C. § 119(a) on Patent Application No(s). 202210011964.0 filed in China on Jan. 6, 2022, the entire contents of which are hereby incorporated by reference.

TECHNICAL FIELD

The disclosure provides a heat transfer device, more particularly to a three-dimensional heat transfer device.

BACKGROUND

The technical principle of a vapor chamber is similar to a heat pipe, but there are differences between them in heat transfer. The heat pipe only transfers heat in one dimension, but the vapor chamber transfers heat in two dimensions and thus has better heat dissipation efficiency. Specifically, the vapor chamber mainly includes a chamber and a capillary structure. The chamber has an interior space for accommodating working fluid, and the capillary is disposed in the interior space. The chamber has a heat absorbing portion and a condensation portion. The working fluid absorbs heat in the heat absorbing portion and vaporizes so as to spread all over the interior space. The vaporized working fluid can be condensed into liquid form in the condensation portion and return to the heat absorbing portion via the capillary structure so as to complete a cooling cycle.

However, the vapor chamber and the heat pipe work independently, and therefore only one dimensional and/or two dimensional heat transfer may be satisfied, which is unable to achieve three dimensional heat transfer.

SUMMARY

The disclosure provides a three-dimensional heat transfer device which can dissipate heat more efficiently.

One embodiment of the disclosure provides a three-dimensional heat transfer device. The three-dimensional heat transfer device includes a first thermally conductive casing, a second thermally conductive casing, at least one first capillary structure, at least one second capillary structure and at least one first heat pipe. The first thermally conductive casing has an outer surface, and the outer surface is configured to be in thermal contact with a heat source. The second thermally conductive casing has at least one first through hole. The second thermally conductive casing is mounted on the first thermally conductive casing, and the first thermally conductive casing and the second thermally conductive casing together form a liquid-tight chamber. The first capillary structure is disposed on the first thermally conductive casing. The second capillary structure is disposed on the first thermally conductive casing. A projection of the first capillary structure and a projection of the second capillary structure on the outer surface and an extension surface of the outer surface are located in an extent of the outer surface, and the second capillary structure is located closer to the second thermally conductive casing than the second capillary structure. The first heat pipe is disposed through the first through hole and in contact with the second capillary structure.

Another embodiment of the disclosure provides a three-dimensional heat transfer device. The three-dimensional heat transfer device includes a first thermally conductive casing, a second thermally conductive casing, at least one thermally conductive protrusion, at least one first capillary structure, at least one second capillary structure and at least one first heat pipe. The second thermally conductive casing has at least one first through hole. The second thermally conductive casing is mounted on the first thermally conductive casing, and the first thermally conductive casing and the second thermally conductive casing together form a liquid-tight chamber. The thermally conductive protrusion protrudes from the first thermally conductive casing. The first capillary structure is stacked on the first thermally conductive casing. The second capillary structure is stacked on the thermally conductive protrusion and thermally coupled with the first capillary structure. The first heat pipe is disposed through the first through hole and in contact with the second capillary structure.

According to the three-dimensional heat transfer device as discussed in the above embodiment, the first heat pipes are in contact with the second capillary structures located closer to the second thermally conductive casing, such that the areas of the capillary structures can be increased, and the backwater distances of the first heat pipes can be reduced so as to improve the heat dissipation efficiency of the three-dimensional heat transfer device.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
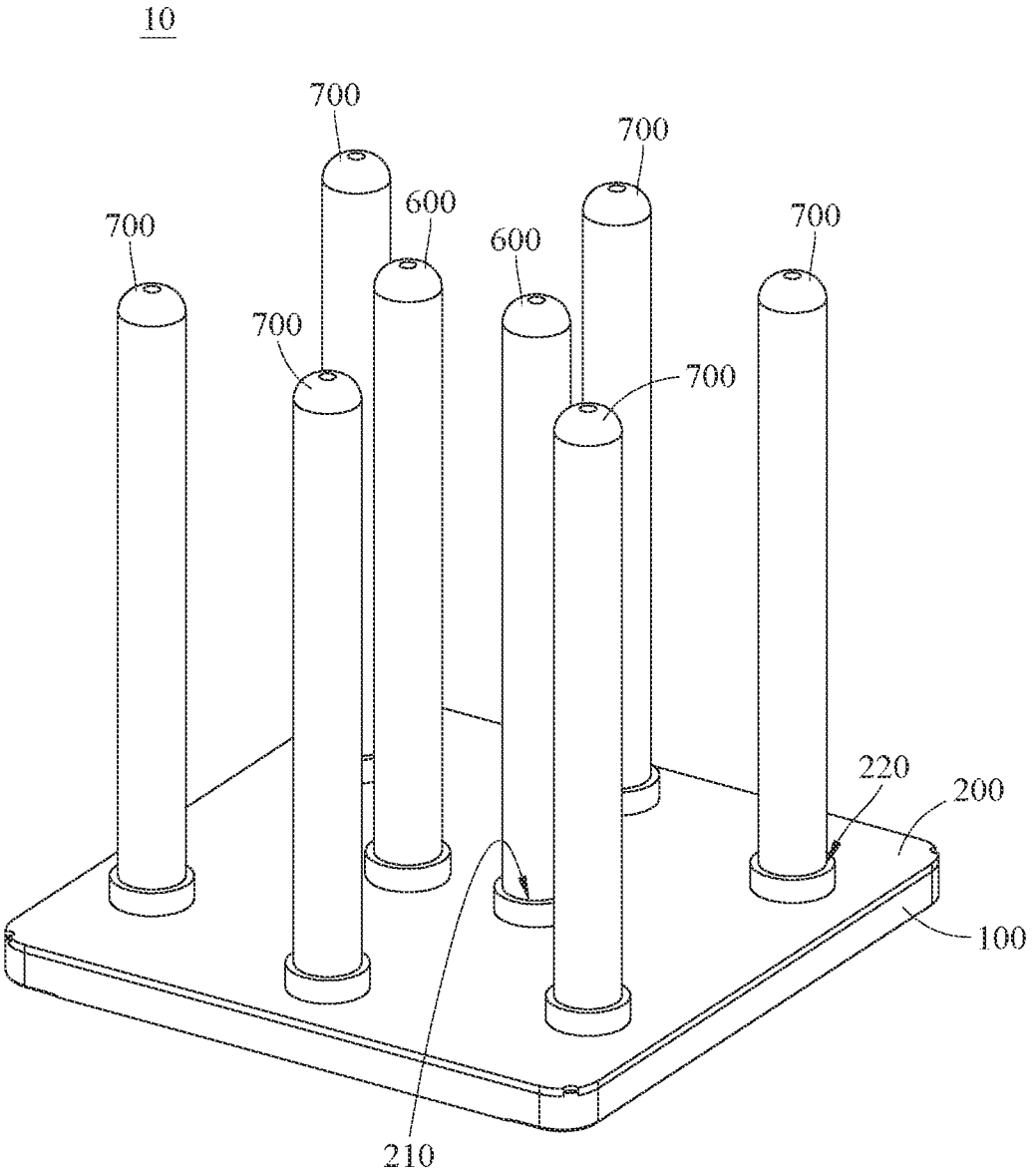
FIG. 1 is a perspective view of a three-dimensional heat transfer device according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
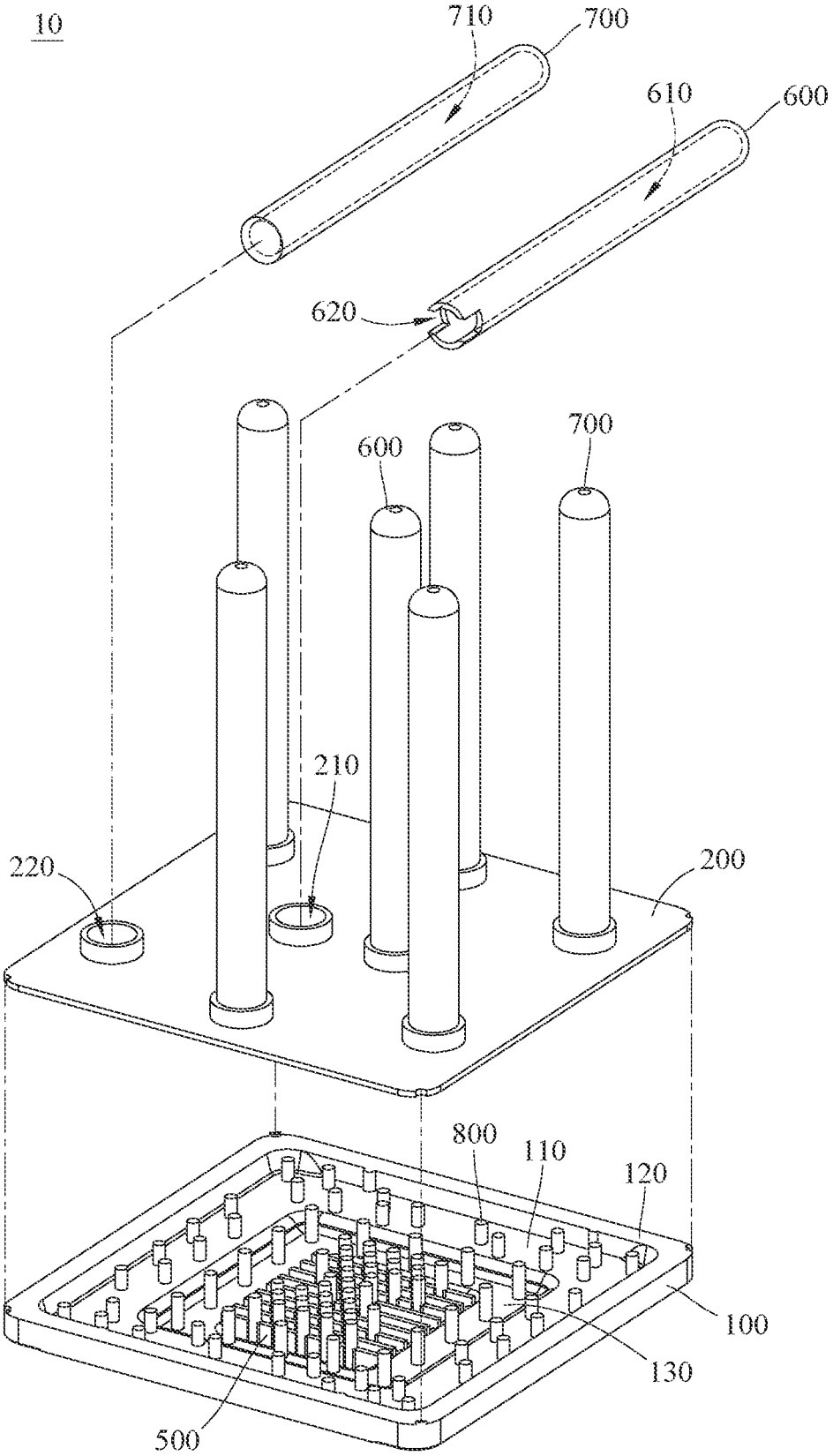
FIG. 2 is an exploded view of the three-dimensional heat transfer device in FIG. 1.

Refer to FIGS. 1 to 4, where FIG. 1 is a perspective view of a three-dimensional heat transfer device 10 according to one embodiment of the disclosure, FIG. 2 is an exploded view of the three-dimensional heat transfer device 10 in FIG.

Figure 3:
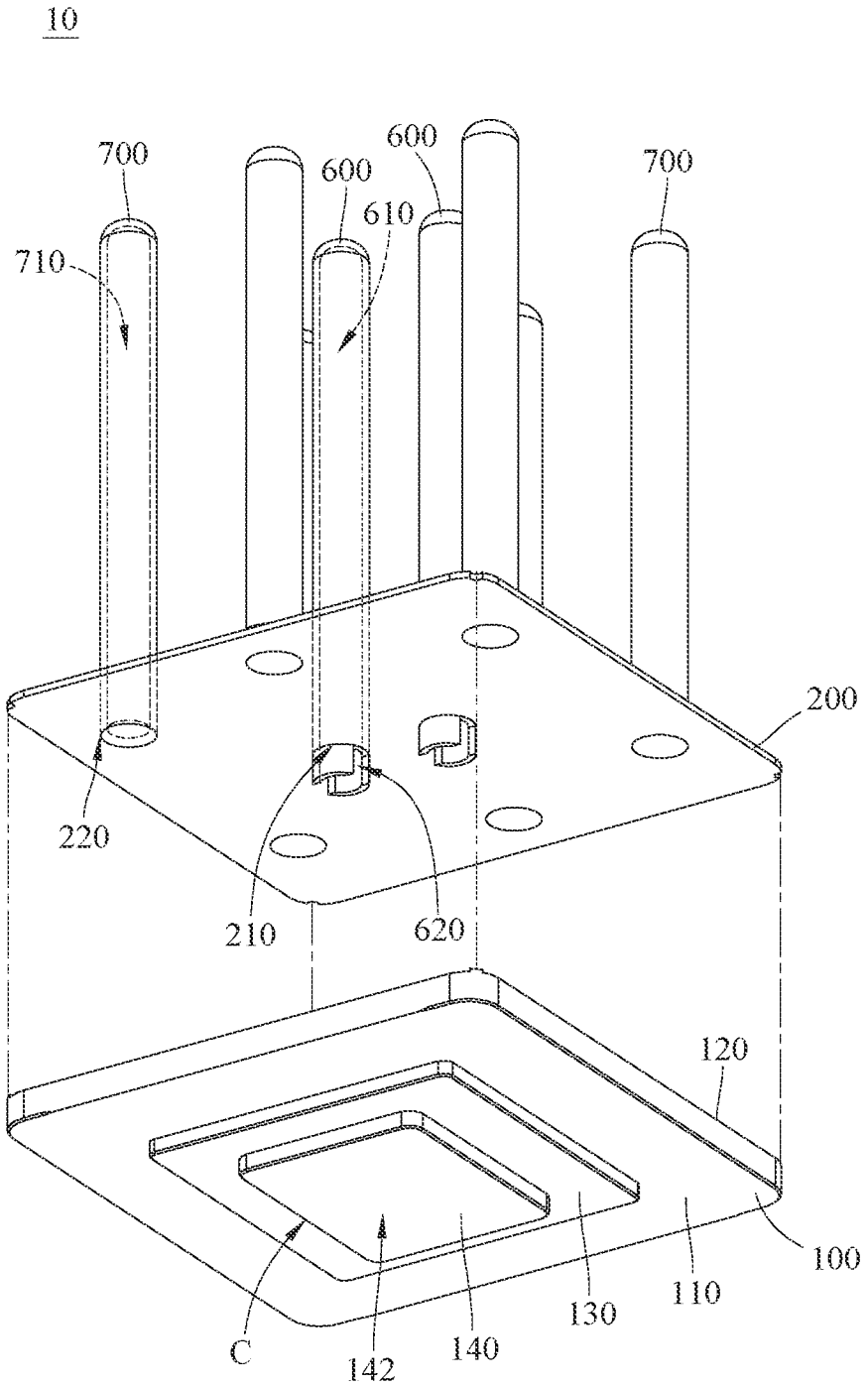
FIG. 3 is another exploded view of the three-dimensional heat transfer device in FIG. 1.
Figure 4:
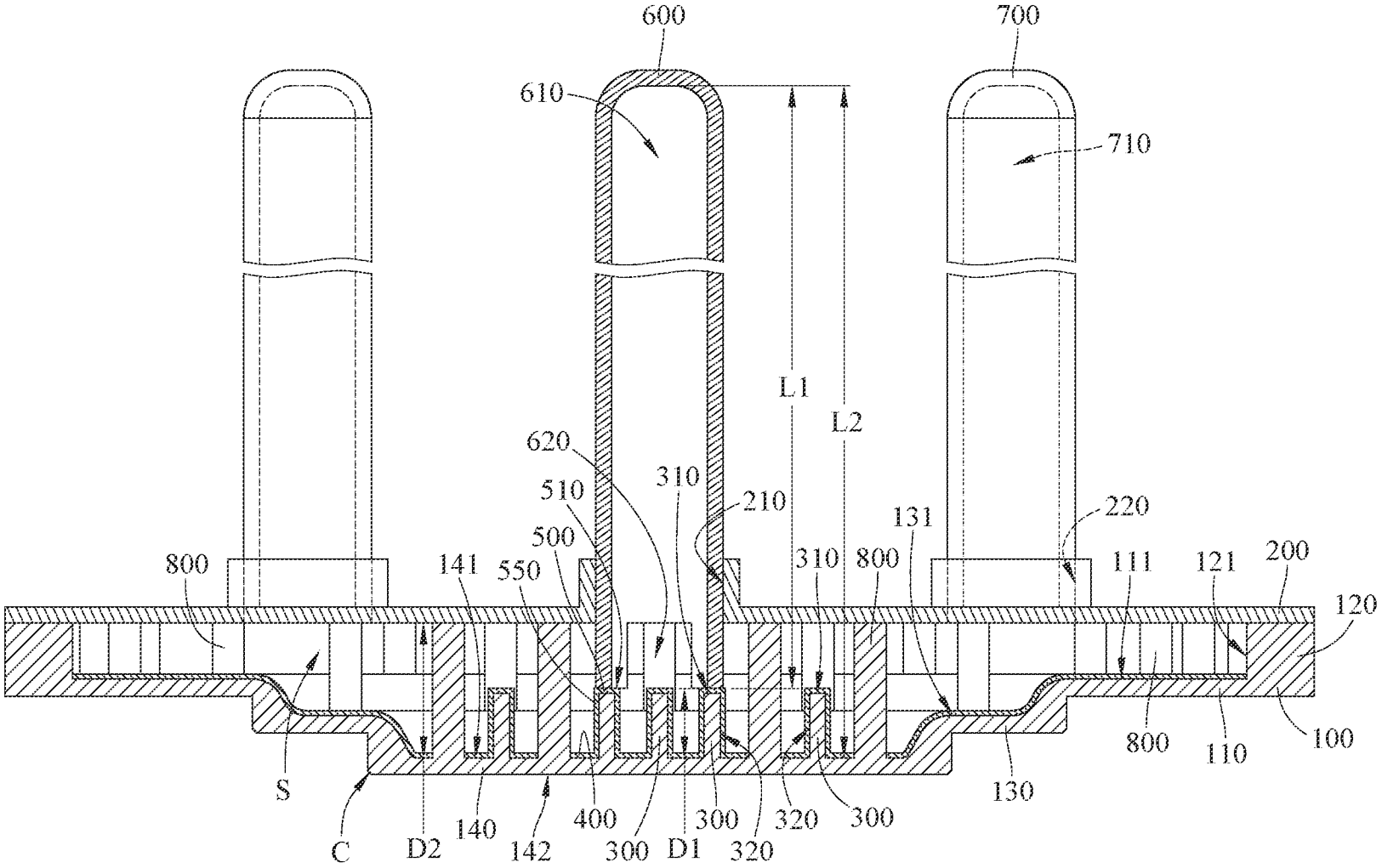
FIG. 4 is a cross-sectional view of the three-dimensional heat transfer device in FIG. 1.

1, FIG. 3 is another exploded view of the three-dimensional heat transfer device 10 in FIG. 1, and FIG. 4 is a cross-sectional view of the three-dimensional heat transfer device 10 in FIG. 1.

In this embodiment, the three-dimensional heat transfer device 10 includes a first thermally conductive casing 100, a second thermally conductive casing 200, a plurality of thermally conductive protrusions 300, a first capillary structure 400, a plurality of second capillary structures 500, a plurality of third capillary structures 550, a plurality of first heat pipes 600 and a plurality of second heat pipes 700.

The first thermally conductive casing 100 and the second thermally conductive casing 200 are, for example, made of metal material via, for example, a sheet metal stamping process. The second thermally conductive casing 200 is mounted on the first thermally conductive casing 100, and the first thermally conductive casing 100 and the second thermally conductive casing 200 together form a liquid-tight chamber S.

The first thermally conductive casing 100 includes a bottom plate 110, an annular side plate 120, a first protrusion structure 130 and a second protrusion structure 140. The annular side plate 120 is connected to a periphery of the bottom plate 110. The first protrusion structure 130 protrudes from the bottom plate 110 along a direction away from the second thermally conductive casing 200. The second protrusion structure 140 protrudes from the first protrusion structure 130 along a direction away from the second thermally conductive casing 200. The second protrusion structure 140 has an inner surface 141 and an outer surface 142 facing away from the inner surface 141. The outer surface 142 is configured to be in thermal contact with a heat source (not shown), such as a CPU or a GPU. The second thermally conductive casing 200 has a plurality of first through holes 210 and a plurality of second through holes 220.

The thermally conductive protrusions 300 are, for example, made of metal material. The thermally conductive protrusions 300 protrude from the inner surface 141 of the second protrusion structure 140 of the first thermally conductive casing 100. In addition, each of the thermally conductive protrusions 300 has a first surface 310 and a second surface 320, where the first surface 310 faces away from the outer surface 142 of the second protrusion structure 140, and the second surface 320 is located between and connected to the first surface 310 and the inner surface 141 of the second protrusion structure 140.

In this embodiment, the thermally conductive protrusions 300 are, for example, rectangular bodies with different lengths, but the disclosure is not limited thereto; in some other embodiments, the thermally conductive protrusion may be non-rectangular bodies as long as a desired vapor pressure drop in the liquid-tight chamber S can be provided, and a high liquid pressure drop caused by the sintered powder capillary structure can be reduced.

In this embodiment, the thermally conductive protrusions 300 are parallel with one another, but the disclosure is not limited thereto; in some other embodiments, the thermally conductive protrusions may be in a radial arrangement.

The first capillary structure 400 and the second capillary structures 500 may be selected from a group consisting of metal net, sintered powder and sintered ceramic. The first capillary structure 400 is stacked on at least part of inner surface 141 of the second protrusion structure 140 of the first thermally conductive casing 100. The second capillary structures 500 are respectively stacked on the first surfaces 310 of the thermally conductive protrusions 300. The third capillary structures 550 are respectively stacked on the second surfaces 320 of the thermally conductive protrusions 300 and connected to the first capillary structure 400 and the second capillary structures 500.

In this embodiment, a projection of the first capillary structure 400 and projections of the second capillary structures 500 on the outer surface 142 and an extension surface of the outer surface 142 are located in an extent of the outer surface 142; that is, the projection of the first capillary structure 400 and the projections of the second capillary structures 500 on the outer surface 142 and the extension surface of the outer surface 142 are located in an area defined by a contour C of the outer surface 142. The second capillary structures 500 are located closer to the second thermally conductive casing 200 than the first capillary structure 400 on the second protrusion structure 140 by disposing the second capillary structures 500 on the first surfaces 310 of the thermally conductive protrusions 300 instead of increasing the thicknesses of the second capillary structures, such that the second capillary structures 500 can have small thickness for reducing thermal resistances. That is, the thicknesses of the second capillary structures 500 can be reduced for achieving small thermal resistances by using the thermally conductive protrusions 300 to elevate the second capillary structures 500. When the thicknesses of the second capillary structures 500 are decreased from 0.6 mm to 0.4 mm, the thermal resistances thereof are decreased from 0.0333° C./W to 0.0222° C./W.

In this embodiment, each of the second capillary structures 500 has a top surface 510 facing away from the second protrusion structure 140, where top surface 510 is spaced apart from the inner surface 141 of the second protrusion structure 140 by a first distance D1. A vapor channel is formed between the inner surface 141 of the second protrusion structure 140 and the second thermally conductive casing 200, and the inner surface 141 of the second protrusion structure 140 is spaced apart from the second thermally conductive casing 200 by a second distance D2. A ratio of the first distance D1 to the second distance D2 is, for example, between 60%~65%:35%~40%.

The first heat pipes 600 and the second heat pipes 700 can be distinguished by the positions where they are disposed. Projections of the first heat pipes 600 on the outer surface 142 of the second protrusion structure 140 and an extension surface of the outer surface 142 are located in the extent of the outer surface 142, which means that the projections of the first heat pipes 600 are located in the area defined by the contour C of the outer surface 142. Projections of the second heat pipes 700 on the outer surface 142 of the second protrusion structure 140 and the extension surface of the outer surface 142 are located outside the outer surface 142, which means that the projections of the second heat pipes 700 are located outside the area defined by the contour C of the outer surface 142.

The first heat pipes 600 are respectively disposed through the first through holes 210, and the first heat pipes 600 are respectively in contact with the second capillary structures 500 stacked on the first surfaces 310 of the thermally conductive protrusions 300, such that the first heat pipes 600 are spaced apart from the first capillary structure 400 stacked on the inner surface 141 of the second protrusion structure 140.

In addition, each of the first heat pipes 600 has a first chamber 610 and an opening 620, where the first chamber 610 is in fluid communication with the liquid-tight chamber S via the opening 620. The opening 620 is configured for working fluid (e.g., vapor) to pass therethrough.

In this embodiment, the first chamber 610 is in fluid communication with the liquid-tight chamber S via the opening 620, but the second capillary structure 500 may still expose a part of the first chamber 610 when the first heat pipe 600 is in contact with the second capillary structure 500. Therefore, in some other embodiments, the first heat pipe may not have the opening 620. In other words, in some other embodiments, the first chamber may be in fluid communication with the liquid-tight chamber via a gap that is not blocked by the second capillary structure.

In this embodiment, capillary structures (not shown) of the first heat pipes 600 are respectively connected to the second capillary structures 500 via metallic bonding manner, which means that capillary structures (not shown) of the first heat pipes 600 are respectively connected to the second capillary structures 500 via sintering process. By doing so, two capillary structures connected to each other can transmit the working fluid more rapidly so as to increase the heat dissipation efficiency of the three-dimensional heat transfer device 10. However, the disclosure is not limited thereto; in some other embodiments, the capillary structures of the first heat pipes may be merely in contact with the second capillary structures.

The second heat pipes 700 are respectively disposed through the second through holes 220, and the second heat pipes 700 are spaced apart from the first capillary structure 400. In addition, each of the second heat pipes 700, for example, has a closed second chamber 710 not in fluid communication with the liquid-tight chamber S.

Each of the support structures 800 has one end connected to the first thermally conductive casing 100 and another end connected to the second thermally conductive casing 200 so as to increase the structural strength of the three-dimensional heat transfer device 10. In this embodiment, the support structures 800 and the thermally conductive protrusions 300 may be integrally formed with the first thermally conductive casing 100 by stamping process, CNC process or another suitable process. In some other embodiments, the support structures and the thermally conductive protrusions may be coupled with the first thermally conductive casing via welding process, diffusion bonding process, thermal pressing process, soldering process, brazing process or adhering process.

In this embodiment, the thermally conductive protrusions 300 are connected to at least some of the support structures 800, but the disclosure is not limited thereto; in some other embodiments, the thermally conductive protrusions 300 may be spaced apart from the support structures 800.

Note that the quantities of the thermally conductive protrusions 300, the second capillary structures 500, the first heat pipes 600, and the second heat pipes 700 are not restricted in the disclosure. In some other embodiments, the quantities of the thermally conductive protrusion, the second capillary structure, the first heat pipe, and the second heat pipe may all be one.

In this embodiment, the three-dimensional heat transfer device 10 includes the first heat pipes 600 and the second heat pipes 700, but the disclosure is not limited thereto; in some other embodiments, the three-dimensional heat transfer device may not include any second heat pipe.

In this embodiment, the first heat pipes 600 are in contact with the second capillary structures 500 stacked on the first surfaces 310 of the thermally conductive protrusions 300 instead of on the first capillary structures 400 stacked on the second protrusion structure 140 of the first thermally conductive casing 100, such that there is no need to form structures on the thermally conductive protrusions 300 for the penetrations of the first heat pipes 600; that is, the volumes of the thermally conductive protrusions 300 can be increased so as to increase areas of the second capillary structures 500. In addition, by doing so, a backwater distance of each first heat pipe 600 can be reduced from L2 to L1 so as to improve the heat dissipation efficiency of the three-dimensional heat transfer device 10.

According to the three-dimensional heat transfer device as discussed in the above embodiment, the first heat pipes are in contact with the second capillary structures located closer to the second thermally conductive casing, such that the areas of the capillary structures can be increased, and the backwater distances of the first heat pipes can be reduced so as to improve the heat dissipation efficiency of the three-dimensional heat transfer device.

In addition, compare with two capillary structures merely in contact with each other, two capillary structures connected to each other via metallic bonding manner can transmit the working fluid more rapidly so as to increase the heat dissipation efficiency of the three-dimensional heat transfer device.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A three-dimensional heat transfer device, comprising:

a first thermally conductive casing having a bottom plate and an outer surface, wherein the outer surface is configured to be in thermal contact with a heat source;

a second thermally conductive casing, having at least one first through hole, wherein the second thermally conductive casing is mounted on the first thermally conductive casing, and the first thermally conductive casing and the second thermally conductive casing together form a liquid-tight chamber;

at least one first capillary structure, disposed on the first thermally conductive casing;

at least one second capillary structure, disposed on the first thermally conductive casing, wherein a projection of the at least one first capillary structure and a projection of the at least one second capillary structure on the outer surface and an extension surface of the outer surface are located in an extent of the outer surface, and the at least one second capillary structure is located closer to the second thermally conductive casing than the at least one first capillary structure;

at least one first heat pipe, disposed through the at least one first through hole and in contact with the at least one second capillary structure;

at least one thermally conductive protrusion where a top surface of the thermally conductive protrusion is vertically offset from the bottom plate; and at least one second heat pipe, wherein: the second thermally conductive casing has at least one second through hole, the at least one second heat pipe is mounted on the at least one second through hole, the at least one second heat pipe is spaced apart from the first thermally conductive casing, the at least one first heat pipe has a first chamber that is in fluid communication with the liquid-tight chamber, the at least one second heat pipe has a second chamber that is not in fluid communication with the liquid-tight chamber, and only the at least one first heat pipe is in contact with the at least one thermally conductive protrusion.

2. The three-dimensional heat transfer device according to claim 1, wherein the first thermally conductive casing comprises an annular side plate, a first protrusion structure and a second protrusion structure, the annular side plate is connected to a periphery of the bottom plate, the first protrusion structure protrudes from the bottom plate along a direction away from the second thermally conductive casing, the second protrusion structure protrudes from the first protrusion structure along a direction away from the second thermally conductive casing, the at least one thermally conductive protrusion protrudes from an inner surface of the second protrusion structure, the at least one first capillary structure is stacked on the inner surface of the second protrusion structure, and the at least one second capillary structure is stacked on the at least one thermally conductive protrusion.

3. The three-dimensional heat transfer device according to claim 2, further comprising at least one third capillary structure, wherein the at least one thermally conductive protrusion has a first surface and a second surface, the first surface faces away from an outer surface of the second protrusion structure, the second surface is located between and connected to the first surface and the inner surface of the second protrusion structure, the at least one second capillary structure is stacked on the first surface of the at least one thermally conductive protrusion, and the at least one third capillary structure is stacked on the second surface of the at least one thermally conductive protrusion and connected to the at least one first capillary structure and the at least one second capillary structure.

4. The three-dimensional heat transfer device according to claim 2, wherein the at least one second capillary structure has a top surface facing away from the second protrusion structure, the top surface is spaced apart from the inner surface of the second protrusion structure by a first distance, a vapor channel is formed between the inner surface of the second protrusion structure and the second thermally conductive casing, the inner surface of the second protrusion structure is spaced apart from the second thermally conductive casing by a second distance, and a ratio of the first distance to the second distance is between 60%-65%: 35%-40%.

5. The three-dimensional heat transfer device according to claim 2, further comprising a plurality of support structures, each of the plurality of support structures including a first end, a second end and a pillar shaped body, wherein the first end connects to the first thermally conductive casing and the second end connects to the second thermally conductive casing.

6. The three-dimensional heat transfer device according to claim 5, wherein the at least one thermally conductive protrusion is connected to at least some of the plurality of support structures.

7. The three-dimensional heat transfer device according to claim 2, wherein the at least one thermally conductive protrusion comprises a plurality of thermally conductive protrusions, and the plurality of thermally conductive protrusions are parallel with one another.

8. The three-dimensional heat transfer device according to claim 2, wherein the at least one thermally conductive protrusion is spaced apart from the second thermally conductive casing.

9. The three-dimensional heat transfer device according to claim 1, wherein the at least one first capillary structure and the at least one second capillary structure are selected from a group consisting of metal net, sintered powder and sintered ceramic.

10. The three-dimensional heat transfer device according to claim 1, wherein a capillary structure of the at least one first heat pipe is connected to the at least one second capillary structure.

11. The three-dimensional heat transfer device according to claim 1, wherein a capillary structure of the at least one first heat pipe is connected to the at least one second capillary structure in metallic bonding manner.

12. A three-dimensional heat transfer device, comprising:

a first thermally conductive casing having a bottom plate;

a second thermally conductive casing, having at least one first through hole, wherein the second thermally conductive casing is mounted on the first thermally conductive casing, and the first thermally conductive casing and the second thermally conductive casing together form a liquid-tight chamber;

at least one thermally conductive protrusion, protruding from the first thermally conductive casing, a top surface of the thermally conductive protrusion being vertically offset from the bottom plate;

at least one first capillary structure, stacked on the first thermally conductive casing;

at least one second capillary structure, stacked on the at least one thermally conductive protrusion and thermally coupled with the at least one first capillary structure;

at least one first heat pipe, disposed through the at least one first through hole and in contact with the at least one second capillary structure;

at least one thermally conductive protrusion where a top surface of the thermally conductive protrusion is vertically offset from the bottom plate; and at least one second heat pipe, wherein: the second thermally conductive casing has at least one second through hole, the at least one second heat pipe is mounted on the at least one second through hole, the at least one second heat pipe is spaced apart from the first thermally conductive casing, the at least one first heat pipe has a first chamber that is in fluid communication with the liquid-tight chamber, the at least one second heat pipe has a second chamber that is not in fluid communication with the liquid-tight chamber, and only the at least one first heat pipe is in contact with the at least one thermally conductive protrusion.

* * * * *